United States Patent [19]

van Alphen et al.

[11] 4,059,781

[45] Nov. 22, 1977

[54] SHADOW MASK EACH APERTURE OF WHICH IS DEFINED BY A QUADRUPOLAR LENS

[75] Inventors: Willem Meijndert van Alphen; Jan Verweel, both of Eindhoven, Netherlands

[73] Assignee: U.S. Philips Corporation, New York, N.Y.

[21] Appl. No.: 780,026

[22] Filed: Mar. 22, 1977

Related U.S. Application Data

[63] Continuation of Ser. No. 590,315, June 25, 1975, abandoned.

[30] Foreign Application Priority Data

July 17, 1974 Netherlands ..... 7409642

[51] Int. Cl.[2] ..... H01J 29/07; H01J 31/20

[52] U.S. Cl. ..... 313/403; 315/375

[58] Field of Search ..... 313/402, 403, 408

[56] References Cited

U.S. PATENT DOCUMENTS

| | | | |
|---|---|---|---|
| 2,728,024 | 12/1955 | Ramberg | 313/408 X |
| 2,734,146 | 2/1956 | Noskowicz | 313/408 X |
| 2,862,141 | 11/1958 | Kruper et al. | 313/408 X |
| 2,971,117 | 2/1961 | Law | 313/408 X |
| 3,016,474 | 1/1962 | Hergenrother | 313/408 X |
| 3,502,942 | 3/1970 | Khan et al. | 313/408 X |
| 3,586,900 | 6/1971 | Seki et al. | 313/408 X |

*Primary Examiner*—Robert Segal

*Attorney, Agent, or Firm*—Frank R. Trifari

[57] ABSTRACT

A post-focusing type color cathode ray tube comprising a quadrupole lens formed in each aperture of the color selection mask.

8 Claims, 6 Drawing Figures

SHADOW MASK EACH APERTURE OF WHICH IS DEFINED BY A QUADRUPOLAR LENS

Figure 1:
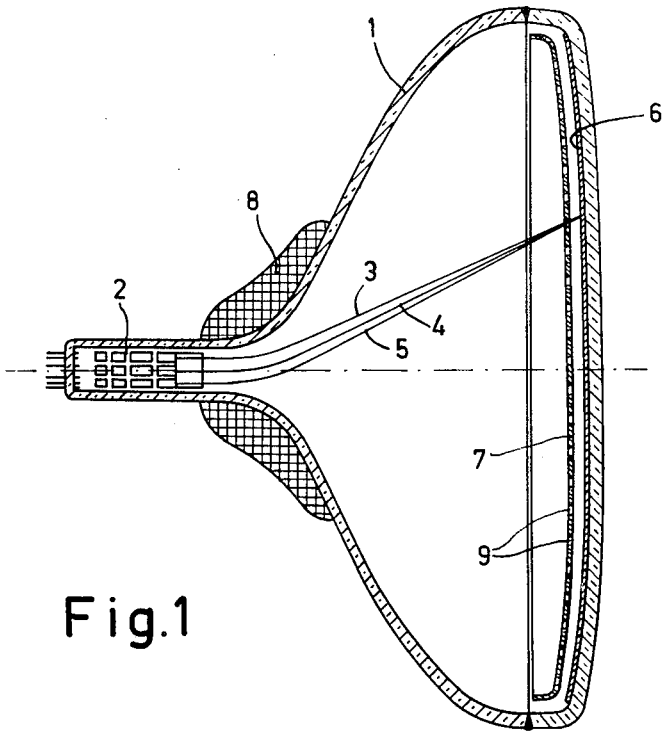

This is a continuation of application Ser. No. 590,315, filed June 25, 1975 now abandoned.

The invention relates to a cathode ray tube for displaying coloured pictures and comprising in an evacuated envelope means to generate a number of electron beams, a display screen comprising a large number of regions luminescing in different colours, and colour selection means comprising a large number of apertures which assign each electron beam to luminescent regions of one colour, which colour selection means comprise electrodes to form an electron lens in each aperture.

Such a post-focusing cathode ray tube is known from the U.S. Pat. No. 3,398,309. The object of post-focusing is to increase the brightness of the displayed picture by increasing the transmission of the colour selection means. In tubes without post-focusing a very large part, for example, 80 to 85%, of the electrons is intercepted by the so-called shadow mask. By using post-focusing the apertures in the colour selection means can be enlarged since as a result of the focusing in the apertures the electron spots on the screen are considerably smaller than the apertures so that nevertheless sufficient landing tolerance exists.

The electron lens which is formed in the apertures of the shadow mask of the known tube is of the unipotential type as a result of which a rather large voltage difference is required between the electrodes which constitute the lens.

Another post-focusing tube is described in the U.S. Pat. No. 2,728,024. In this tube the electron beams pass successively through two flat grids consisting of parallel conductors. The conductors belonging to different grids extend at right angles to each other. The result of this construction is that the electron beams are successively focused by two electronoptical cylinder lenses which are rotated 90° with respect to each other. By the combined action of the two lenses the electron beams are focused in one direction and defocused in a direction at right angles thereto.

A drawback of this known tube is also that a rather large voltage difference is necessary for the focusing. In addition, both grids do not form a mechanical unit so that the vibration of the grid wires presents great problems. In addition it is necessary for the display screen to be flat.

It is an object of the invention to provide a cathode ray tube for displaying coloured pictures of the kind mentioned in the preamble which does not exhibit the said drawbacks. For that purpose, a quadrupole lens is formed in each aperture of the colour selection means. Quadrupole lenses are relatively very strong since the electric field extends at right angles to the electron path, so that much lower voltages will suffice. That a quadrupole lens focuses in one direction and defocuses in a direction at right angles thereto is no objection in principle if all the quadrupoles have the same orientation. Therefore, the luminescent regions of the display screen have the shape of substantially parallel strips the longitudinal direction of which is substantially parallel to the defocusing direction of the quadrupole lenses.

In a suitable embodiment of a tube according to the invention the colour selection means are formed by a grid consisting of two sets of parallel conductors which cross each other or are interwoven, said conductors being electrically insulated from and mechanically connected to each other at the crossings, the conductors of each set being electrically connected together.

In another suitable embodiment of the invention the colour selection means are formed by a metal plate which comprises said apertures and includes conductive strips between the rows of apertures, said strips being electrically connected together and insulated from the plate.

Voltage from an external voltage source may be applied to the electrodes which constitute the quadrupole lenses.

It is also possible to electrically connect to the display screen those electrodes conveying the highest positive potential of the electrodes which constitute the quadrupole lenses, and not to connect the electrodes conveying the lowest positive potential to an external source and to cause them to be charged by the electron beams.

Figure 2:
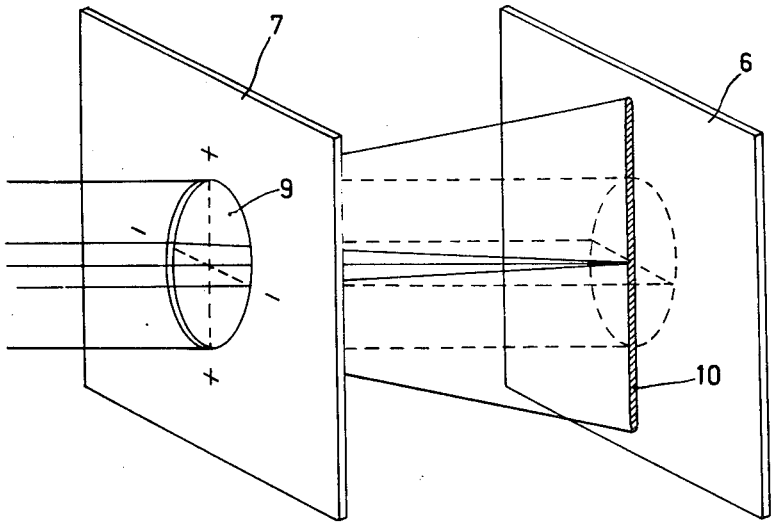
Figure 3:
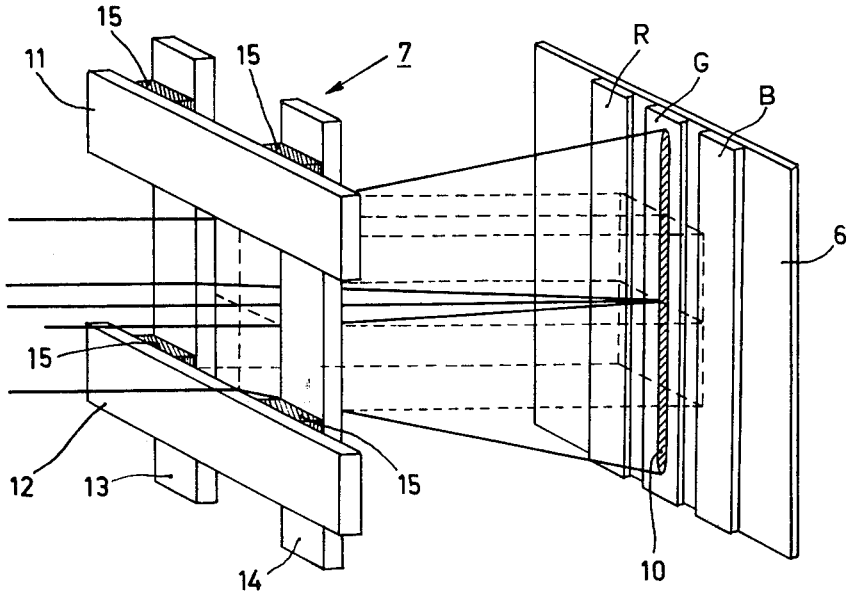
Figure 6:
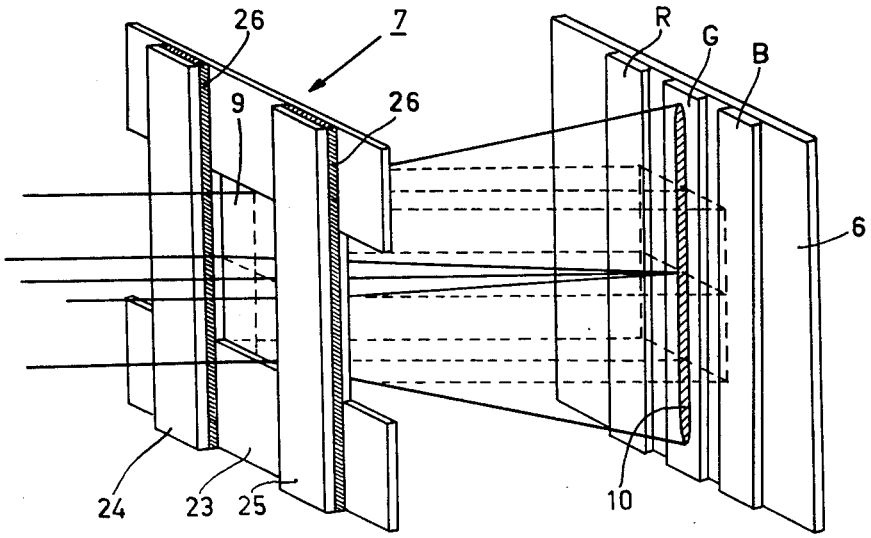
Figure 4:
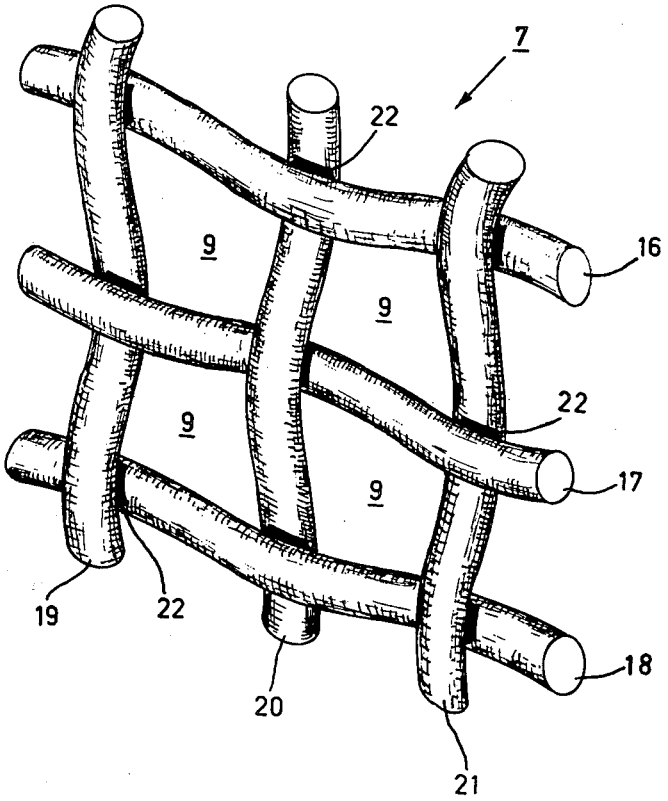
Figure 5:
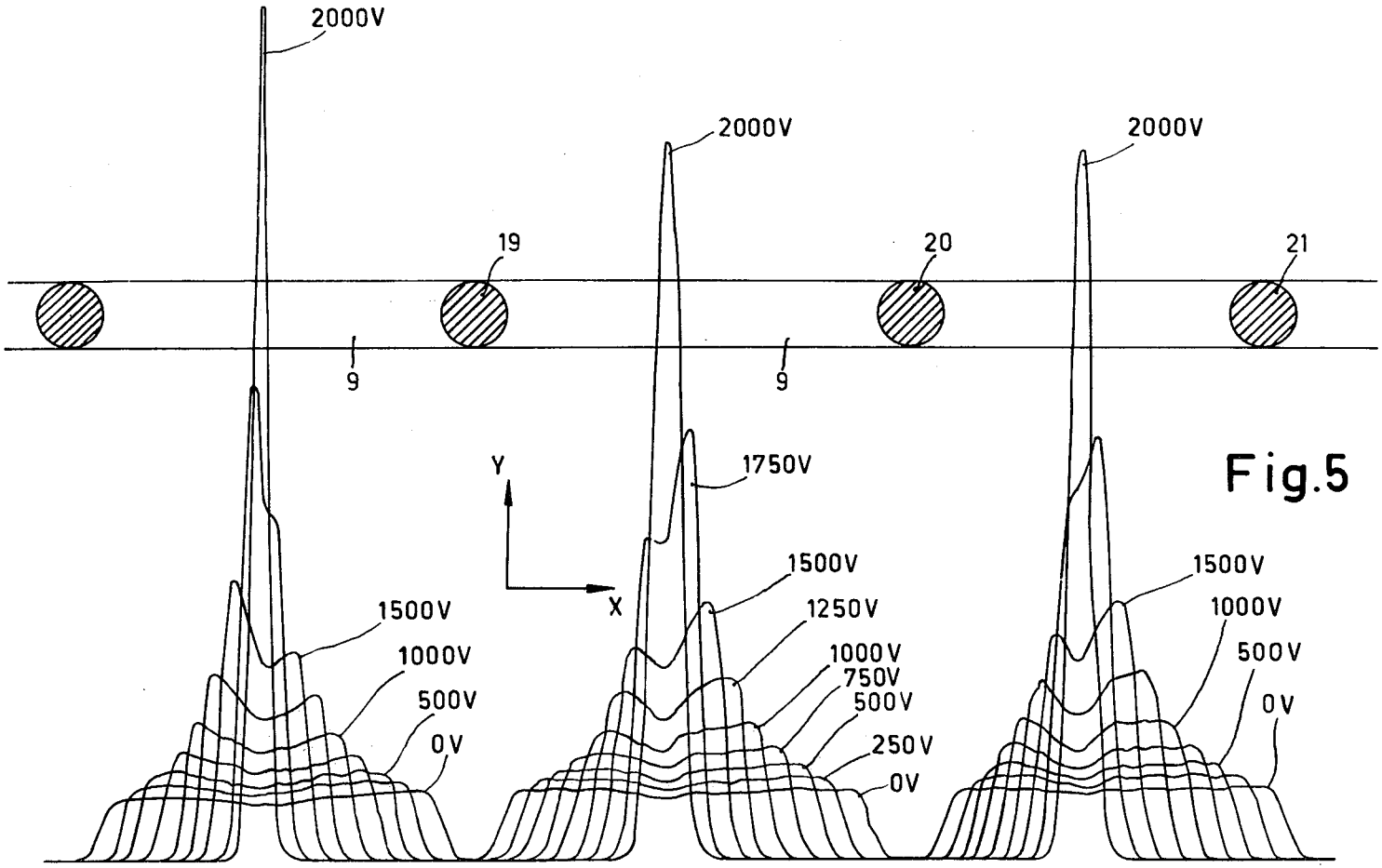

The invention will be described in greater detail with reference to the accompanying drawing, in which FIG. 1 shows a cathode ray tube for displaying coloured pictures according to the invention, FIG. 2 serves to elucidate the principle of the invention, FIG. 3 shows a first embodiment according to the invention, FIG. 4 shows a second embodiment according to the invention, FIG. 5 shows measured results, and FIG. 6 shows a third embodiment according to the invention.

The tube shown in FIG. 1 comprises a glass envelope 1, means 2 to generate three electron beams 3, 4 and 5, a display screen 6, colour selection means 7 and deflection coils 8. The electron beams 3, 4 and 5 are generated in one plane, the plane of the drawing in FIG. 1, and are deflected onto the display screen 6 by means of the deflection coils 8. The display screen 6 comprises a large number of phosphor strips which luminesce in red, green and blue, respectively, and the longitudinal direction of which is at right angles to the plane of the drawing of FIG. 1. During normal operation of the tube the phosphor strips are vertical and FIG. 1 hence represents a horizontal sectional view of the tube. The colour selection means 7 which will be described in greater detail with reference to FIGS. 3, 4 and 6 comprise a large number of apertures 9 which are shown diagrammatically only in FIG. 1. The three electron beams 3, 4 and 5 pass through the apertures 9 at a small angle with each other and consequently each impinge only on phosphor strips of one colour. The apertures 9 in the colour selection means 7 are thus very accurately positioned relative to the phosphor strips of the display screen 6.

In the presently generally used shadow mask tube the electron beams 3, 4 and 5 are not focused upon passing through the apertures 9. In the already mentioned U.S. Pat. No. 3,398,309, unipotential lenses for focusing the electron beams are formed in the apertures 9. It has also been suggested to use post-focusng by means of a potential difference between the colour selection means 7 and the display screen 6, in which, however, much hindrance is experienced from secondary electrons.

According to the invention a quadrupole lens is formed in each aperture. FIG. 2 shows such a quadrupole lens diagrammatically. A part of the colour selection means 7 and one of the apertures 9 is shown. The potential variation along the edge of the aperture 9 is denoted +, −, +, − in such manner that a quadrupole field is formed, i.e. electrostatic fields are formed having substantially hyperbolic configurations. The electron beam which passes through the aperture 9 is focused in the horizontally shown plane and is defocused in the vertically shown plane as a result of which the electron spot 10 is formed if the display screen is exactly at the horizontal focal point. As will be described in greater detail, it is not recommended to focus exactly on the display screen 6, as a result of which a slightly wider electron spot is obtained. It is only of secondary influence on the focusing when the electron beam passes through the aperture 9 at a small angle. As a result of this the colour selection of the three electron beams 3, 4 and 5 takes place in a manner quite analogous to that in the known shadow mask tube. As a result of the strong focusing, however, the aperture 9 may be much larger than in the known shadow mask tube so that a much a larger number of electrons impinge upon the display screen 6 and a brighter picture is formed. The defocusing in the vertical direction need not be a drawback if phosphor strips are used which are parallel to the longitudinal direction of the spot 10. Colour selection means comprising a large number of quadrupole lenses have been realized in three ways.

In FIG. 3 the colour selection means 7 comprise two sets of parallel conductors crossing each other. Of the first set the horizontally shown conductors 11 and 12 are shown. Of the second set the vertically shown conductors 13 and 14 are shown. The conductors 11, 12, 13 and 14 determine one of the apertures 9 and are insulated from each other by means of insulation material 15. The three phosphor strips belonging to the aperture 9 are shown on the display screen 6 and are denoted by R (red), G (green) and B (blue). Only a few rays of the central electron beam 4 are shown in the Figure which form electron spot 10 on the phosphor strip G. The horizontal conductors, including 11 and 12, are connected together and are at a higher potential than the vertical conductors, including 13 and 14, connected together, as a result of which the quadrupole lens shown diagrammatically in FIG. 2 is formed in each aperture 9.

FIG. 4 shows a slightly varied embodiment of the colour selection means 7 in which interwoven horizontal and vertical conductors are used. A few horizontal conductors are designated 16, 17 and 18 and a few vertical conductors are designated 19, 20 and 21. The conductors are insulated from each other by means of insulation material 22.

The colour selection means shown in FIGS. 3 and 4 are manufactured as follows. Two sets of iron wires (the wires are preferably ferro-magnetic in connection with the screening of the earth's magnetic field) which are provided with glass insulation are pressed against each other in the desired manner in a mould or are interwoven (FIG. 4). The assembly is then heated so that the wires with the glass insulation fuse together without, however, making electric contact with each other. the glass insulation is then removed from the wire, with the exception of the crossings, so as to avoid undesired charging of the glass. This latter may be carried out by means of jets of powder from both sides in which the insulation of the crossing is in the shadow of the conductors or by spraying an etchant which reaches the insulation of the crossings with greater difficulty than elsewhere.

The following results are achieved in the colour selection means shown in FIG. 4 assembled in a display tube and having conductors of a diameter of 0.24 mm and a mutual pitch of 0.80 mm, as a result of which the transmission of the colour selection means is approximately 50%. With a potential of the display screen 6 of 25 kV and a potential of the vertical conductors of 24.55 kV and of the horizontal conductors of 25.45 kV, the focal distance of the quadrupole lenses is 18.0 mm in the centre of the display screen with incidence at right angles and 12.7 mm with an incidence of 37° in the corners of the display screen. The distance between the colour selection means 7 and the display screen 6 is 15 mm in the centre and 10 mm at the edge so that the focal point of the quadrupole lenses everywhere lies just slightly beyond the display screen. As a result of this it is prevented that a so-called focal ring is visible on the display screen. The electron spots in the centre of the display screen are 0.10 mm wide and in the corner 0.09 mm wide. A suitable width of the phosphor strips R, G and B then is 0.13 mm. The remainder of the surface of the display screen may or may not be covered with a light-absorbing material.

FIG. 5 shows a few measured results obtained with a configuration as shown in FIG. 4 in a special measuring tube. In this case the diameter of the conductors was 0.2 mm and the pitch was on an average 1.2 mm. The $x$-direction is parallel to a horizontal line on the display screen. The light output in arbitrary units is plotted in the $y$-direction and is measured by means of a very small aperture in a diaphragm which scans the display screen in the $x$-direction and a photomultiplier which receives the light which passes through the small aperture and converts it into an electric signal. The measurements have been carried out at 0 Volt to 2000 Volts voltage difference between the horizontal and the vertical conductors, in steps of 250 Volts. The very strong focusing at 2000 Volts is clearly visible in FIG. 5. At 0 Volt only the vertical conductors produce shadow on the display screen and a uniformly illuminated spot is present behind each aperture 9. From the very steep edges of the measured curves the very small influence of secondary electrons appears which in the known tube with post-focusing form a hazy edge (hals) around the light spots.

A third embodiment of the colour selection means 7 is shown in FIG. 6. In this case it consists of an iron plate 23 which has apertures 9 and a large number of vertical conductive strips two of which are shown between the apertures 9 and are designated 24 and 25. The conductive strips are insulated from the iron plate by means of insulation material 26. The plate 23 has a thickness of 0.15 mm. The insulation material 26, a glass layer, has a thickness of 0.06 mm. The conductive strips consist of vapour-deposited aluminum and have a thickness of 0.0005 mm. The apertures 9 are 0.56 × 0.56 mm and their pitch is 0.8 mm so that the transmission of the colour selection means is approximately 50%. With a potential of the display screen 6 of 25 kV, a potential of the plate 23 of likewise 25 kV and a potential of the conductive strips 24 and 25 of 23.4 kV, the focal distance of the quadrupole lenses is 18 mm in the case of normal incidence in the centre of the display screen and 12.7 mm in the case of incidence at 37° at the edge of the display screen. The distance between the display screen 6 and the colour selection means 7 is 15 mm in the centre of the display screen and 10 mm at the edge. The electron spots in the centre of the display screen are 0.10 mm wide and 0.09 mm in the corners and no focal ring is visible on the display screen. The width of the phosphor strips R, G and B is 0.13 mm. The remainder of the display screen may or may not be provided with a light-absorbing material.

The display screen 6 and the plate 23 are connected electrically and receive their voltage of 25 kV from an external voltage source. The voltage of 23.4 kV which is applied to the conductive strips 24 and 25 may also originate from an external voltage source. It is also possible not to connect the conductive strips to an external voltage source, but to cause them to be charged by the electron beams. Due to the charging with the electron beams, the quadrupole field is gradually formed in the apertures 9, as a result of the focusing effect of which the strips 24 and 25 will be hit by the electron beams to an ever decreasing extent. The final condition is stable and independent of the beam current because only very little current is necessary to maintain the potential of the strips 24 and 25.

A display screen for a tube according to the invention can be manufactured with a known exposure method in which the colour selection means are reproduced on a photo-sensitive layer on a window portion of the tube. In connection with the large transmission of the colour selection means according to the invention, the exposure method used should be suitable to reproduce the apertures 9 in a strongly narrowed manner. An exposure method suitable for this purpose uses two or more light sources at some distance from each other, as is described in the German patent application No. 2,248,878. Of course, a tube according to the invention is also excellently suitable for so-called electronic exposure in which the sensitive layer on the window portion is "exposed" by means of an electron beam.

What is claimed is:

1. A color television image producing tube comprising, an evacuated envelope, means to generate a plurality of electron beams, a display screen having a plurality of regions of elongate form luminescing in different colors, means for selectively impinging said beams each upon a respective luminescent color region, said means comprising an apertured electrode system interposed between said beam generating means and said display screen, said apertured electrode system comprising a plurality of quadrupolar lenses each defining an aperture for the passage of said beams to an associated color region of said screen, said quadrupolar lens comprising two pairs of electrode elements arranged in space quadrature, the electrode elements of each pair being arranged in spaced opposing relationship transverse to the path of said beams through the aperture oppositely confronting electrodes of said pairs operating at the same potential and adjacently positioned electrodes of said pairs operating at a potential difference whereby electrostatic fields having substantially hyperbolic configurations are formed between each adjacent pair of said electrodes.

2. A color television tube as claimed in claim 1 wherein the luminescent regions of the display screen have the form of substantially parallel strips the longitudinal direction of which is substantially parallel to the defocusing direction of the quadrupole lenses.

3. A color television tube as claimed in claim 1 wherein said beam inpinging means are formed by a grid comprising two sets of parallel conductors which cross each other, said conductors being electrically insulated from and mechanically connected to each other at the crossing points and with the conductors of each set being electrically connected together.

4. A color television tube as claimed in claim 3, characterized in that both sets of conductors are interwoven.

5. A color television tube as claimed in claim 1 wherein the beam impinging means comprises a metal plate which includes said apertures and conductive strips located between the rows of apertures of substantially rectangular form, said strips being electrically connected together and being insulated from the plate.

6. A color television tube as claimed in claim 1 further comprising an external voltage source for applying voltages to the electrode elements which constitute the quadropole lenses.

7. A color television tube as claimed in claim 1 further comprising means electrically connecting the electrodes of the quadrupole lenses which have the highest positive potential to the display screen, and wherein the electrodes having the lowest positive potential are not connected to an external voltage source but are charged by the electron beams.

8. A color television tube as claimed in claim 2 wherein said pairs of electrode elements of the apertured electrode system are located approximately in a single plane transverse to the electron beam paths and form a single integrated structure, each of said two pairs of electrode elements defining two pairs of electric poles surrounding each of said apertures, and means for applying said operating potential to a first pair of said electrode elements and a different operating potential to a second pair of electrode elements whereby each quadrupole lens focuses said electron beams in one direction and defocuses them in a perpendicular direction.

* * * * *

UNITED STATES PATENT AND TRADEMARK OFFICE

CERTIFICATE OF CORRECTION

PATENT NO. : 4,059,781

DATED : November 22, 1977

INVENTOR(S) : WILLEM MEIJNDERT VAN ALPHEN

It is certified that error appears in the above-identified patent and that said Letters Patent are hereby corrected as shown below:

Column 4, line 43, after "appears" insert --,--

Claim 1, line 16, after "aperture" insert --,--

Signed and Sealed this

Ninth Day of May 1978

[SEAL]

Attest:

RUTH C. MASON
Attesting Officer

LUTRELLE F. PARKER
Acting Commissioner of Patents and Trademarks